US007311304B1

(12) United States Patent
Kelly

(10) Patent No.: US 7,311,304 B1
(45) Date of Patent: Dec. 25, 2007

(54) GAME APPARATUS WITH MULTIPLE MOVING ELEMENTS

(75) Inventor: Bryan M. Kelly, Alamo, CA (US)

(73) Assignee: Arcade Planet, Inc., Livermore, CA (US)

( * ) Notice: Subject to any disclaimer, the term of this patent is extended or adjusted under 35 U.S.C. 154(b) by 587 days.

(21) Appl. No.: 10/194,397

(22) Filed: Jul. 12, 2002

Related U.S. Application Data

(60) Provisional application No. 60/305,381, filed on Jul. 13, 2001.

(51) Int. Cl.
*A63B 71/00* (2006.01)

(52) U.S. Cl. ..... 273/138.3; 273/138.4

(58) Field of Classification Search ..... 273/142 E, 273/142 F, 142 G, 144 R, 145 R, 145 A, 273/145 B, 145 C, 144 A, 144 B, 138.2–138.5, 273/384, 390, 368, 366, 454, 440
See application file for complete search history.

(56) References Cited

U.S. PATENT DOCUMENTS 4,744,566 A * 5/1988 Malavazos et al. ..... 273/357
4,846,476 A * 7/1989 Hanna ..... 273/144 A
5,062,635 A * 11/1991 Tse et al. ..... 273/144 A
5,120,060 A * 6/1992 Parker et al. ..... 273/138.2
5,275,402 A * 1/1994 Malavazos et al. ..... 273/138.2
5,312,103 A * 5/1994 Chateau ..... 273/144 A
5,423,542 A * 6/1995 Oraha ..... 273/144 B
5,427,374 A * 6/1995 Ulloa et al. ..... 273/144 B
5,511,794 A * 4/1996 Katamoto ..... 273/440
5,553,865 A * 9/1996 Shoemaker et al. ..... 273/448
5,622,366 A * 4/1997 Inoue ..... 273/138.2
5,667,217 A * 9/1997 Kelly et al. ..... 273/126 R
5,702,101 A * 12/1997 Russell ..... 273/144 B
5,725,212 A * 3/1998 Garrett ..... 273/144 R
5,967,515 A * 10/1999 Halliburton ..... 273/138.2
6,092,807 A * 7/2000 Yu ..... 273/144 R
6,145,836 A * 11/2000 Toulemonde et al. ... 273/144 R
6,206,370 B1 * 3/2001 Halliburton ..... 273/138.1
6,264,197 B1 * 7/2001 Halliburton ..... 273/138.2
6,375,186 B1 * 4/2002 Joo ..... 273/144 B
6,435,501 B2 * 8/2002 Naden ..... 273/144 A
6,467,772 B2 * 10/2002 Tamura et al. ..... 273/355
6,550,768 B2 * 4/2003 Jordan ..... 273/138.3

* cited by examiner

*Primary Examiner*—Robert E. Pezzuto
*Assistant Examiner*—Alex F. R. P. Rada, II
(74) *Attorney, Agent, or Firm*—TIPS Group

(57) ABSTRACT

An apparatus for providing an arcade game with multiple moving elements, where a player must engage all moving elements with a playing piece to engage a target and earn a reward. The game apparatus has a guiding member having a first motion, a target surface having a second motion, and a playing piece initiated into the game apparatus by a player. The playing piece engages the guiding mechanism having a first motion. In order to properly engage the target surface having a second motion, the player must initiate the playing piece at a proper time such that the guiding mechanism guides the playing piece to the target.

23 Claims, 10 Drawing Sheets

GAME APPARATUS WITH MULTIPLE MOVING ELEMENTS

This application claims priority to provisional application U.S. Ser. No. 60/305,381 filed on Jul. 13, 2001 by Brian Kelly.

FIELD OF THE INVENTION

This invention relates generally to arcade and redemption games having moving elements, and more particularly to systems and methods for providing an arcade game allowing a playing piece to engage multiple moving elements.

BACKGROUND OF THE INVENTION

Arcade games have existed for many years. They are most common at amusement parks, arcades, and other entertainment centers. Many of these arcade games require a player to accomplish some task within a game of skill to earn a reward. The task is usually simple in theory but difficult enough to retain a player's interest through several attempts at playing the game.

With the development of computers and computer processing, entertainment centers have added video games and other forms of computer-based entertainment to their inventories. Despite this evolving trend, many arcades and entertainment centers have continued to offer arcade games for their game-playing customers. However, the video games have attracted many players away from playing traditional arcade games. Thus, continued profitability of arcade games requires that they possess characteristics that draw modern game players' interest and business.

The prior art has attempted to draw a player's interest by providing a moving element within an arcade game. An example of such an arcade game is the typical 'wheel of fortune' arcade game. In the traditional wheel of fortune game, a rotating wheel has several indicia located on separated portions of the wheel corresponding to various rewards or penalties. A player spins the wheel and receives the reward or penalty nearest to an indicator, thus increasing or decreasing his or her score. Though the prior art includes many other arcade games, none require a player to navigate more than one moving element at a time.

The prior art has several disadvantages. The arcade games of the prior art that have only one moving element are generally not too difficult. Thus, an arcade game with only one moving element may be learned and mastered by a player within a short period of time. This is not profitable for arcade game owners and establishments. Further, the games of the prior art become boring and predictable to game players who figure out how the single moving element works into the game. This causes a game to become repetitive, predictable, and boring to players who are not likely to give such arcade games much of their business.

What is needed is an arcade game that is simple and yet difficult enough to attract players to play the arcade game.

SUMMARY

The present invention provides an apparatus and method for providing a game with multiple moving elements. The invention requires a player to initiate a playing piece into the game at a proper time such that the playing piece will properly engage multiple moving parts, one at a time, to engage a target. Upon successfully directing a playing piece to engage two moving elements and a target, the player earns a reward.

A game apparatus with multiple moving elements in accordance with the present invention includes a playing piece, a guiding mechanism having a first motion, and a target surface having a target and a second motion. A player directs the playing piece into the game apparatus. The playing piece must be initiated into the game apparatus such that it will engage the moving guiding mechanism at a position where it will guide the playing piece to a target on a moving target surface.

In one embodiment of the present invention, the playing piece frictionally engages a surface of said guiding mechanism. The first motion of the guiding mechanism may be a cyclic, bi-directional motion that is controlled by an operator. The first motion may be caused by a rotating member in contact with a surface of the guiding mechanism. The game apparatus has a mechanism for rejecting undesirable objects such as counterfeit playing pieces. In a preferred embodiment, the playing piece is a token that is directed to engage the guiding mechanism by a gravitational force.

In another embodiment, the moving target surface includes more than one target that can be engaged by a guiding mechanism. Each target has a detection device for detecting when a playing piece successfully engages the target. In a preferred embodiment, the targets are wells with optical detection mechanisms. In a more preferred embodiment, the target surface is a cylindrically shaped rotating structure with several sets of targets operable to be engaged by several guiding mechanisms. If a playing piece fails to engage a target, it is directed into a default well. If a player engages a target with a playing piece, that player earns a reward based on the difficulty of the target or the number of targets engaged.

A method for providing a game apparatus with multiple moving elements includes providing guiding mechanism having a first motion, providing a target surface having a second motion and a target, and providing a playing piece directed by a player such that the playing piece engages said guiding mechanism in order to engage a target.

In one embodiment of the present invention, the playing piece is a token that frictionally engages a surface of the guiding mechanism. The first motion is a cyclic bi-directional motion A player inserts a playing piece into the game apparatus in an attempt to engage a target on a moving target surface. The game apparatus may have several games, each of which including a guiding mechanism, a target surface, and at least one target. In a preferred embodiment, the target surface is a rotating cylindrical structure that severs all the games of the game apparatus In a more preferred embodiment, the target surface rotates less than ninety degrees in one direction, then back the other direction to the point it started from.

The multiple moving elements add difficulty and excitement to the game. The added excitement of requiring a player to navigate a playing piece so that it engages two moving elements makes the game apparatus of the present invention much more difficult to figure out for a player. This provides for more plays per player, which in turn makes the game more profitable for the owner.

BRIEF DESCRIPTION OF THE DRAWINGS

The invention may best be understood by reference to the following description taken in conjunction with the accompanying drawings in which.

DETAILED DESCRIPTION OF THE PREFERRED EMBODIMENTS

Figure 1:
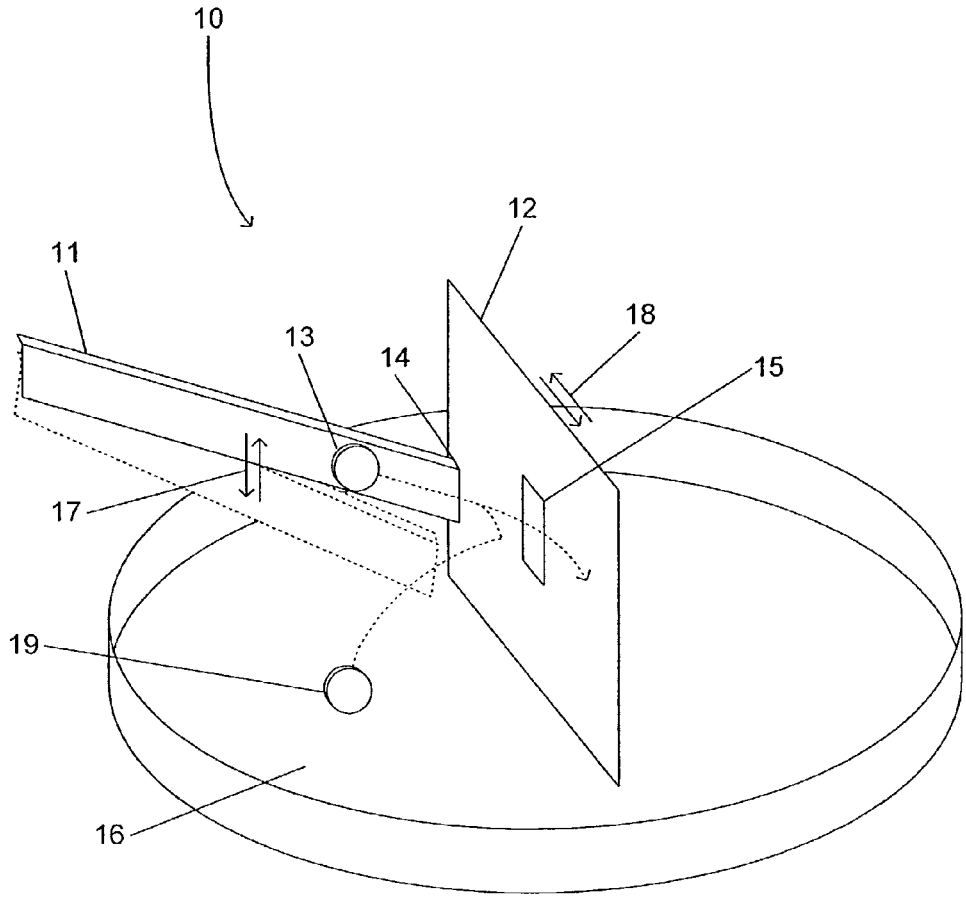
FIG. 1 is a diagram of a game apparatus with multiple moving elements in one embodiment of the present invention.

FIG. 1 depicts a game apparatus with multiple moving elements in accordance with one embodiment of the present invention. As shown in FIG. 1, game apparatus 10 includes a guiding mechanism 11 having a first motion, a target surface 12 having a second motion, different than the first motion, and a playing piece 13. The guiding apparatus 11 includes an end 14 for directing the playing piece 13 towards the target surface 12. The target surface 12 includes at least one target 15. In a preferred embodiment of the present invention, the target is a well such that a playing piece may pass through the well. The game apparatus also includes a default well 16 for collecting playing pieces that fail to engage a target. In a preferred embodiment, the player will have control of the first motion, but the second will be largely automated In a further preferred embodiment, a player is able to set difficulty levels of the first and second motions.

The operation of the game apparatus 10 of FIG. 1 will now be described. The guiding apparatus has a motion 17. In one embodiment, the motion is a bi-directional cyclic motion that displaces end 14 of guiding mechanism 11 vertically up and down in a repeated manner. The target surface has a motion 18 contrary to the motion 17 of the guiding apparatus. In one embodiment, the motion 18 of the target surface is a bi-directional motion moving the target and target surface in a lateral direction from side to side, in a manner perpendicular to the motion of the guiding apparatus. A player initiates a playing piece 13 into the game apparatus 10 so as to engage the guiding apparatus 11. The player attempts to time the initiation of the playing piece 13 so that the playing piece will also engage the target 15 on target surface 12. If a player fails to engage target 15, the playing piece will be directed to default well 16, as shown by playing piece 19.

Figure 2:
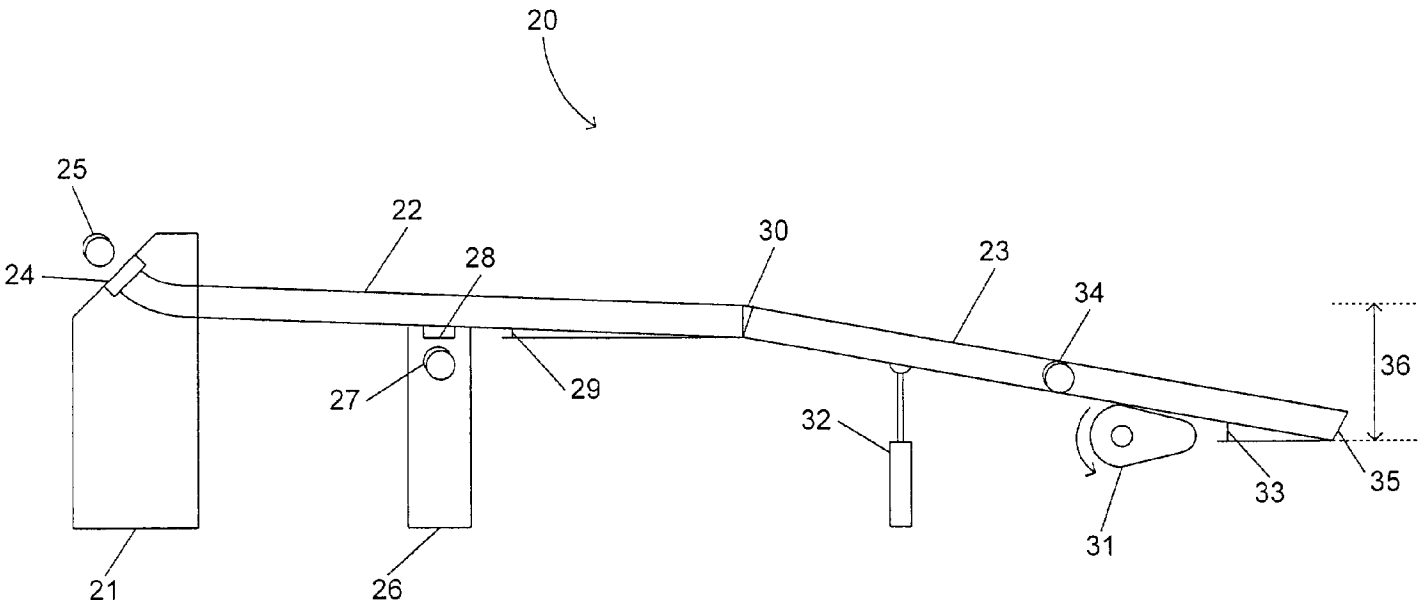
FIG. 2 is a diagram of a guiding mechanism in one embodiment of the present invention.

FIG. 2 depicts example of a guiding mechanism 20 in accordance with one embodiment of the present invention. The guiding mechanism 20 includes a game start mechanism 21, a first guiding member 22, and a second guiding member 23. The game start mechanism 21 includes a playing piece insert 24 for inserting a playing piece 25. The playing piece 25 may be any number of objects. In one embodiment, the playing piece has a shape that allows it to engage a surface of the guiding mechanism as directed by a gravitational force. In a preferred embodiment, the playing piece is a token that is capable of frictionally engaging a surface of the guiding mechanism. The playing piece insert may be any opening or device that allows a playing piece to be initiated into the game apparatus. In a preferred embodiment, the playing piece insert is a slot that allows a token type playing pieces to be initiated into the game apparatus.

In this embodiment, the first guiding member 22 includes object rejection apparatus 26. In one embodiment of the present invention, object rejection apparatus 26 includes an opening 28 for collecting non-desirable objects 27 such as counterfeit tokens and other objects improperly introduced into the game apparatus. Thus, if a non-desirable object is initiated into the game apparatus, the object is directed to the object rejection apparatus 26 and thereby prevented from engaging the guiding mechanism or the target surface. In one embodiment, the first guiding member is configured to utilize gravitational force to direct a playing piece to engage a surface of the first guiding member. In the embodiment shown in FIG. 2, a first end of the guiding member 22 coupled to game start mechanism 21 is displaced at a higher position then a second end of the guiding member 22 coupled to connecting member 30. The difference in height between the first and second end of the guiding member configures the first guiding member to be at a downwards angle. This angle allows the playing piece to be directed by a gravitational force from the first end to the second end.

Transition member 30 couples the first guiding member 22 to the second guiding member 23. The transition member 30 may be any mechanism or device that allows a playing piece to engage the second guiding member. The second guiding member 23 is coupled to a rotating member 31 and a support member 32. In the embodiment shown in FIG. 2, the rotating member 31 is a rotating cam having a non-circular outer surface and the support member 32 is a plunger device. The second guiding member is fixably attached to transition member 30 and slidably attached to rotating member 31 and support member 32. Similar to the first guiding member 22, the second guiding member 23 utilizes a gravitational force to direct a playing piece 34 to engage a surface of the second guiding member. Thus, the second guiding member is configured so that a first end coupled to transition member 30 is displaced at a higher position than a second end 35. The difference in height between the first end at transition member 30 and the second end 35 configures the second guiding member 23 to be at a downwards angle. This angle allows the playing piece 34 to be directed by a gravitational force from the first end to the second end. Further, as the rotating member 31 rotates, the rotating member 31 correspondingly displaces the second guiding member vertically through a range 36. Though the elevation of the second end 35 varies, the position of the second end does not rise above the position of the first end connected to transition member 30. Thus, the second guiding member has a slope from the first end to the second end that varies over time but never allows the second end to reach a higher point than the first end. FIG. 2 shows one embodiment of the present invention where the first guiding member and second guiding member are substantially straight. Those skilled in the art will appreciate that either guiding member may take the form of a variety of shapes such as loops, zig zags, curvature, or any other shape, all of which are considered within the scope of the present invention. Further, factors capable of adjustment such as the speed and shape of the rotating member may be adjusted by an operator and are considered within the scope of the present invention.

Figure 3:
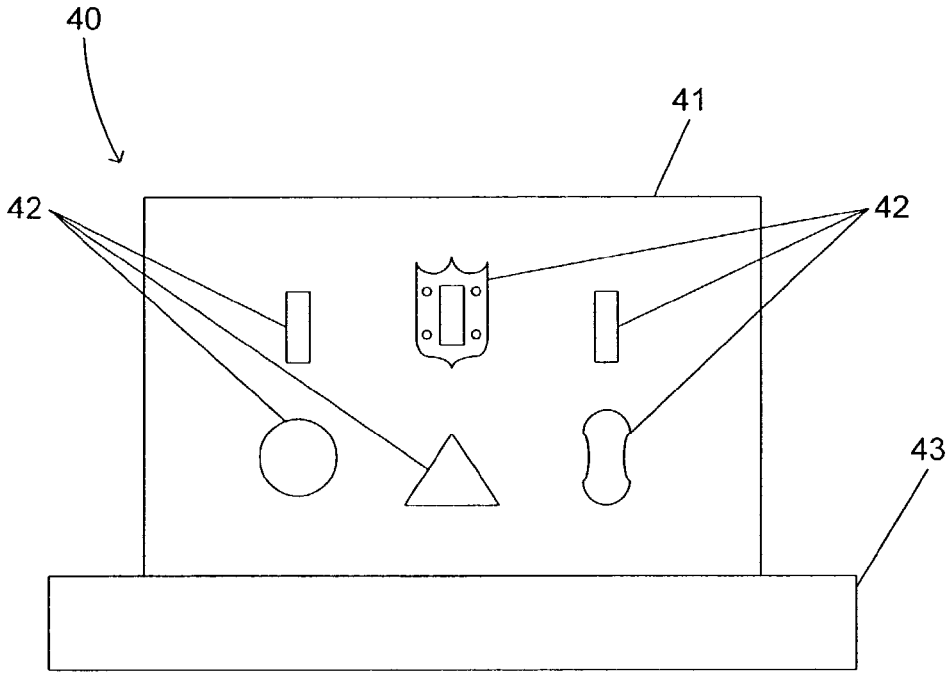
FIG. 3 is a diagram illustrating a front view of a target surface in one embodiment of the present invention.

FIG. 3 depicts a front view of a target surface 40 in accordance with one embodiment of the present invention. Target surface 40 includes a surface 41 with targets 42, in a base 43 that provides a range of motion as well as a catch for tokens. In one embodiment, the targets are surfaces that a playing piece may engage by establishing contact. In another embodiment, the targets are openings or wells that a playing piece may engage by traveling through. The targets 42 may have any shape such as the square target, rectangle target, a circle target, a triangle target, or some abstract shape as in target. The target may also include a structure attached to the perimeter of the target to enhance game play or establish a theme to the game apparatus. It will be appreciated by those skilled in the art that surfaces, wells, and other mechanisms for creating a target may have a variety of possible forms, all of which are included within the scope of the present invention.

Figure 4:
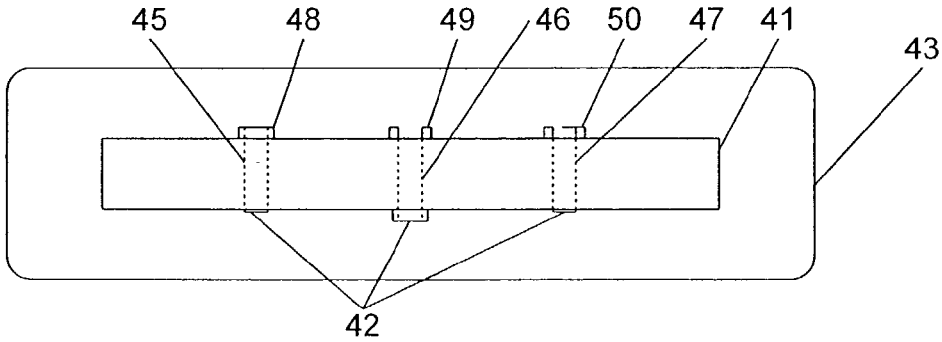
FIG. 4 is a diagram illustrating a top view of a target surface in one embodiment of the present invention.

FIG. 4 depicts a top view of a target surface 40 in accordance with one embodiment of the present invention. Target surface 40 includes a surface 41 and targets 42. As discussed above, targets may have a structure attached to enhance game play or establish a theme to the game apparatus. The structure attached to the target may protrude from the target surface, as shown with base 43. In one embodiment of the present invention wherein the targets are wells, the wells 45 extend through the target surface 41 as shown in FIG. 4.

The targets include an event detection mechanism for detecting when a playing piece successfully engages a target. In one embodiment of the present invention where the target is a well, the playing piece successfully engages the target when it goes into the well. Thus, the event detection mechanisms 48, 49, and 50 detect a playing piece that has passed through respective wells 45. In one preferred embodiment, the playing piece passing through the well is detected with optical circuitry. However, it will be appreciated by those skilled in the art that a mechanism for detecting a playing piece engaging a well may be one of many devices, the specific type of which is not considered central to the spirit of the present invention. In a further refinement of the preferred embodiment, rewards are dependent on which particular target/well 42/45 a playing piece engages, whereby a circle may be worth more rewards than a square, for example.

Figure 5:
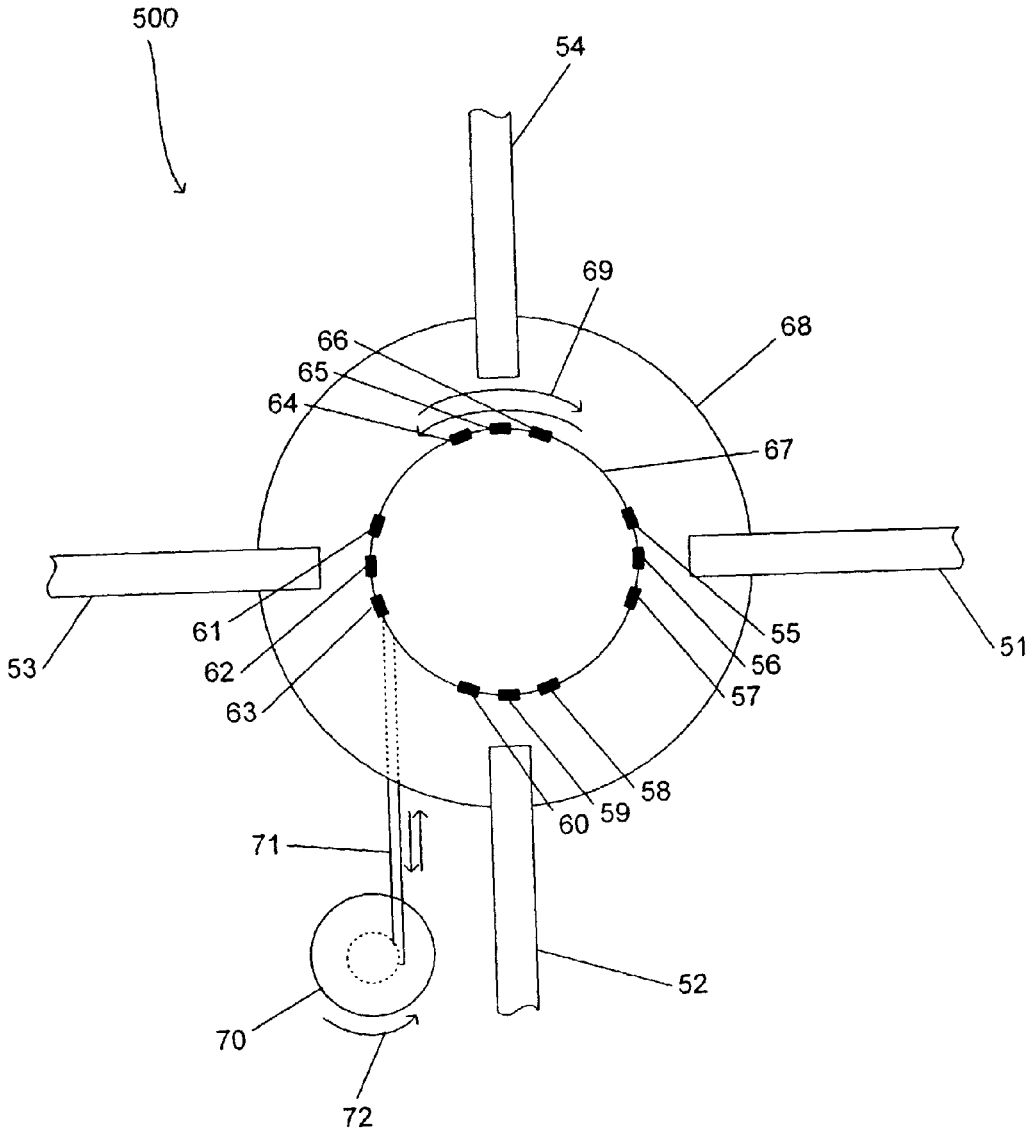
FIG. 5 is a diagram illustrating a top view of a game apparatus with multiple games in one embodiment of the present invention.

In one embodiment of the present invention, a game apparatus may include several games. In such an embodiment, each game includes a guiding mechanism and a target surface having at least one target. FIG. 5 is a top view of a game apparatus 500 having four games Each game consists of a guiding apparatus, a target surface, and three targets. Other aspects of the game apparatus were intentionally omitted from FIG. 5 for clarity purposes. Target surface 67 has a substantially cylindrical shape, and comprises the target surface for all four games. Thus, game one consists of a guiding mechanism 51, target surface 67, and targets 55, 56, and 57. Game two consists of a guiding mechanism 52, target surface 67, and targets 58, 59, and 60. Game three consists of a guiding mechanism 53, target surface 67, and targets 61, 62, and 63. Game four consists of a guiding mechanism 54, target surface 67, and targets 64, 65, and 66. Also included in the game apparatus 500 is default well 68. In a preferred embodiment the player has a general control over the guiding mechanism 51-54, though this control may be limited in a variety of fashions. Most preferably, the player does not have control over the motion of the target surface 67, though a player might be able to set a difficulty level which in essence selects a type of automated motion.

In one embodiment, the cylindrical target surface has a rotational motion 69. The cylindrical motion may be provided by an electrical motor or other means. In one embodiment of the present invention shown in FIG. 5, the electrical motor 70 is coupled to a first end of a driving member 71. A second end of driving member 71 is coupled to the cylindrical target surface 67. As the electrical motor 70 produces a rotational motion 72, the driving member 71 displaces the cylindrical target surface in a rotational manner. In this embodiment, the range of the cylindrical target surface's motion determines which targets can be engaged by each guiding mechanism. In a preferred embodiment, the rotation of the cylindrical target surface is less than ninety degrees. In this embodiment, each target corresponds to only one guiding apparatus. For example, a playing piece may only engage targets 58-60 if the piece is directed through guiding mechanism 52. In another embodiment, the rotation for the cylindrical target surface may be more than ninety degrees, thereby allowing multiple guiding mechanisms to engage a single target. Variable factors such as the speed of the motor and the range of the rotation may all be adjusted by an operator and are considered within the scope of the present invention.

Figure 6:
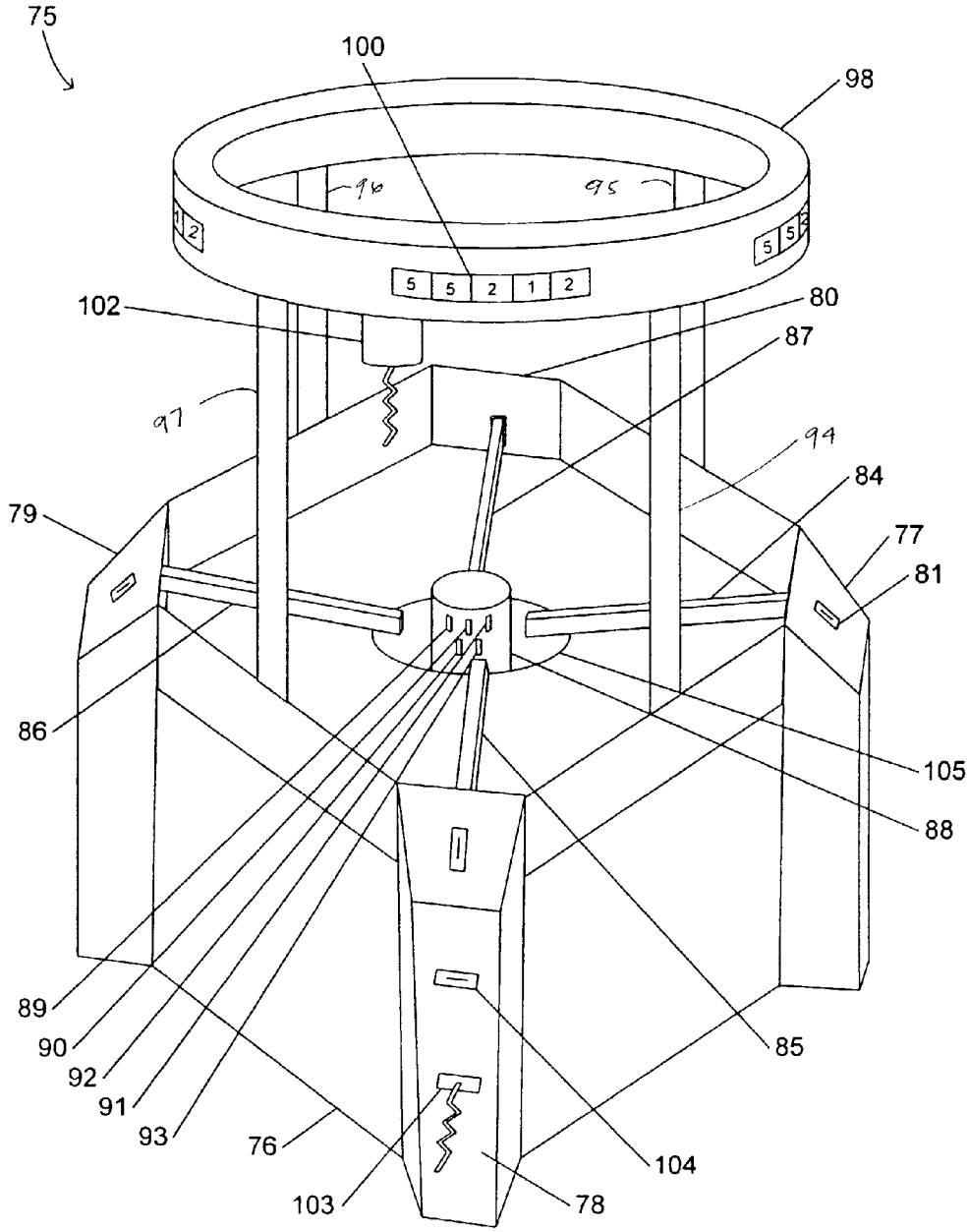
FIG. 6 is a diagram illustrating a front elevated view of a game apparatus with multiple games in one embodiment of the present invention.
Figure 7:
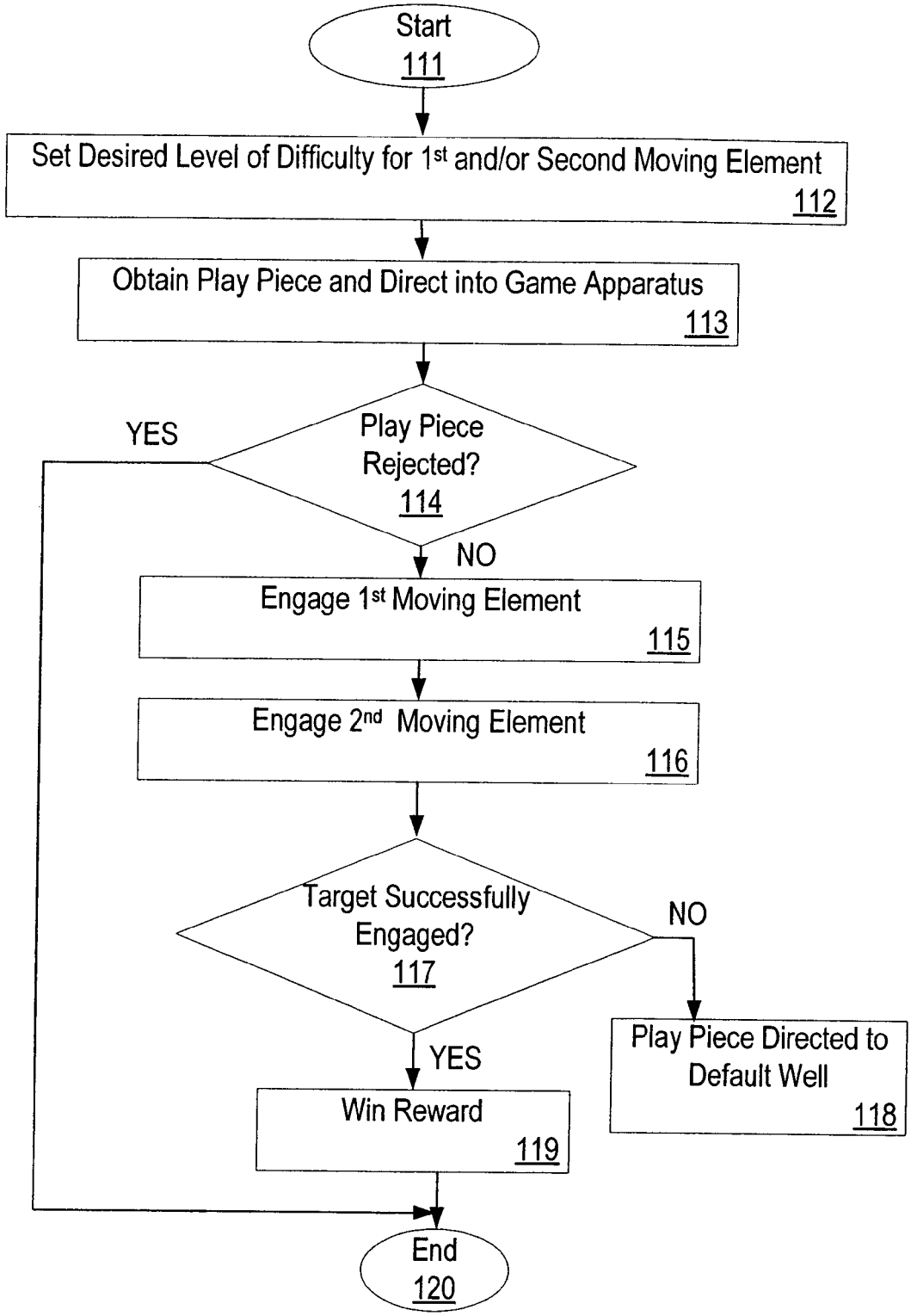
FIG. 7 is a flow diagram illustrating the process of playing a game within a game apparatus in one embodiment of the present invention.

FIG. 6 shows a game apparatus 75 from an elevated point of view having four games, in accordance with one embodiment of the present invention. The game apparatus 75 includes a base cabinet 76 that houses circuitry, processors, and other aspects of the present invention not shown. The game apparatus also includes game stations 77-80, playing piece inserts 81, guiding mechanisms 84-87, target surface 88, targets 89-93, support members 94-97, upper cabinet 98, and LED displays 100. The game apparatus may also include ticket dispensers 102 and 103, a credit application device 104, and default well 105. The game stations are where a player positions himself or herself in order to play one of the games within the game apparatus. The LED displays 100 may indicate a numerical value such as a player's score or a bonus that any player can win at any time once a task is achieved. The LEDs in the embodiment shown are located on the upper cabinet so as to increase visibility. The ticket dispensers 102 and 103 dispense tickets to a player who has accomplished a task in a game. Preferably, each game station has at least one ticket dispenser that dispenses tickets to players at that game station. In one embodiment, a player pays a credit through credit application device to receive playing pieces. The credit may be in the form of a token, a magnetized card, or any other device. In another embodiment of the present invention, a player inserts a coin or token into playing piece insert 81, to play a game within the game apparatus.

With reference to FIGS. 1, 2, 5, and 6, FIG. 7 shows a flow diagram illustrating the operation of playing a game apparatus, in accordance with one embodiment of the present invention. The step 110 begins with a start step 111. In step 112, the desired level of difficulty for the $1^{st}$ and $2^{nd}$ moving elements is set. As discussed above, this may include paying a credit to the game apparatus in some manner. In another embodiment, the player may already have a playing piece in the form of a coin or token, so a player need not pay a credit to the game apparatus to play a game. In step 113, a player obtains a playing piece and directs the playing piece into the game apparatus. This may be accomplished by inserting the playing piece into a game start mechanism, such as the game start mechanism 21 shown in FIG. 2. In another embodiment, this may be accomplished by engaging a release device that introduces a playing piece into the game apparatus. The next step 114 determines if the playing piece is rejected by the game apparatus. This may be a rejection apperatus as shown in FIG. 2, where the object rejection apparatus 26 prevents objects not conforming to the size or shape of a desired playing piece from proceeding towards the target surface. Such a mechanism is useful for preventing a player from using a counterfeit token or from inserting objects that may damage the game apparatus. As shown in FIG. 2, if an object 27 is determined to not conform to a playing piece specification, the object is directed to the object rejection apparatus through opening 28. If a playing piece is rejected, game play operation ends at step 120. If the token is not directed to the object rejection apparatus, then the playing piece proceeds to engage the first moving element in a next step 115.

In step 115, the playing piece engages a first moving element. In the embodiment shown in FIG. 2, the first moving element is the guiding mechanism 20 such that the playing piece frictionally engages a top surface of the guiding member. In one embodiment, the playing piece is a token that frictionally engages the guiding member by rolling down a shoot. After engaging a first guiding member 22, the playing piece engages a second guiding member 23 of the guiding mechanism. As shown, for example, in FIG. 2 and discussed above, the second guiding member has a second motion.

Next, the playing piece engages a second moving element in step 116. The playing piece is directed from one end of the first moving element in the direction of the second moving element. As shown in FIG. 1, the first moving element may be a guiding mechanism 11 and the second moving element may be a target surface 12. Generally, the target surface 12 moves in a different manner then the guiding mechanism 11. In a preferred embodiment and as discussed above, the target surface is a cylindrical structure and moves in a rotational direction as shown in FIG. 5. In this embodiment, the first moving element, guiding mechanism 51, directs a playing piece at the cylindrical target surface while the first moving element has vertical cyclic motion while the guiding apparatus moves in a bi-directional vertical direction. The target surface moves rotationally on an axis located at the center of the cylinder. In a preferred embodiment, the rotating cylindrical target surface rotates in one direction less then ninety degrees, then back the other direction the same angle, such that the cylindrical surface area has returned to it's starting position. This embodiment provides for targets on the surface area to be exclusively engaged by particular players, as discussed above. Thus, although both the first and second elements are continually moving, the playing piece will always engage a portion of the rotating target surface.

In step 117 it is determined whether or not the playing piece has successfully engaged a target on the target area. As shown in FIG. 1 and discussed above, the goal of a player is to direct the playing piece to engage the moving guiding mechanism 11 in such a manner that will cause the playing piece to exit the guiding mechanism end 14 and engage a target 15 on moving target surface 12. As discussed above, a target 15 may be a surface, well, or any other mechanism for determining when a playing piece is properly directed towards a specific area at a proper time. If in step 117 a player failed to successfully engage a target, then the playing piece is directed into a default well in step 118, followed by the end of the game in step 120. In one embodiment, a playing piece that fails to engage a target falls into a basin that collects playing pieces. The playing pieces may then be collected by an operator at a later time or dispersed by the game apparatus upon the payment of a credit. In one embodiment of the present invention, the game apparatus may also detect whether the playing piece is directed into the default basin in order to control game functions such as lighting and sound effects, thereby indicating an event has occurred. If the playing piece successfully engages a target in step 117, then the game play process proceeds to step 119. Step 119 indicates that a player has successfully engaged a target, and performs game operations such as dispersing a reward and providing sound, lighting, and any moving part effects. The game play process then ends in step 120.

Figure 8:
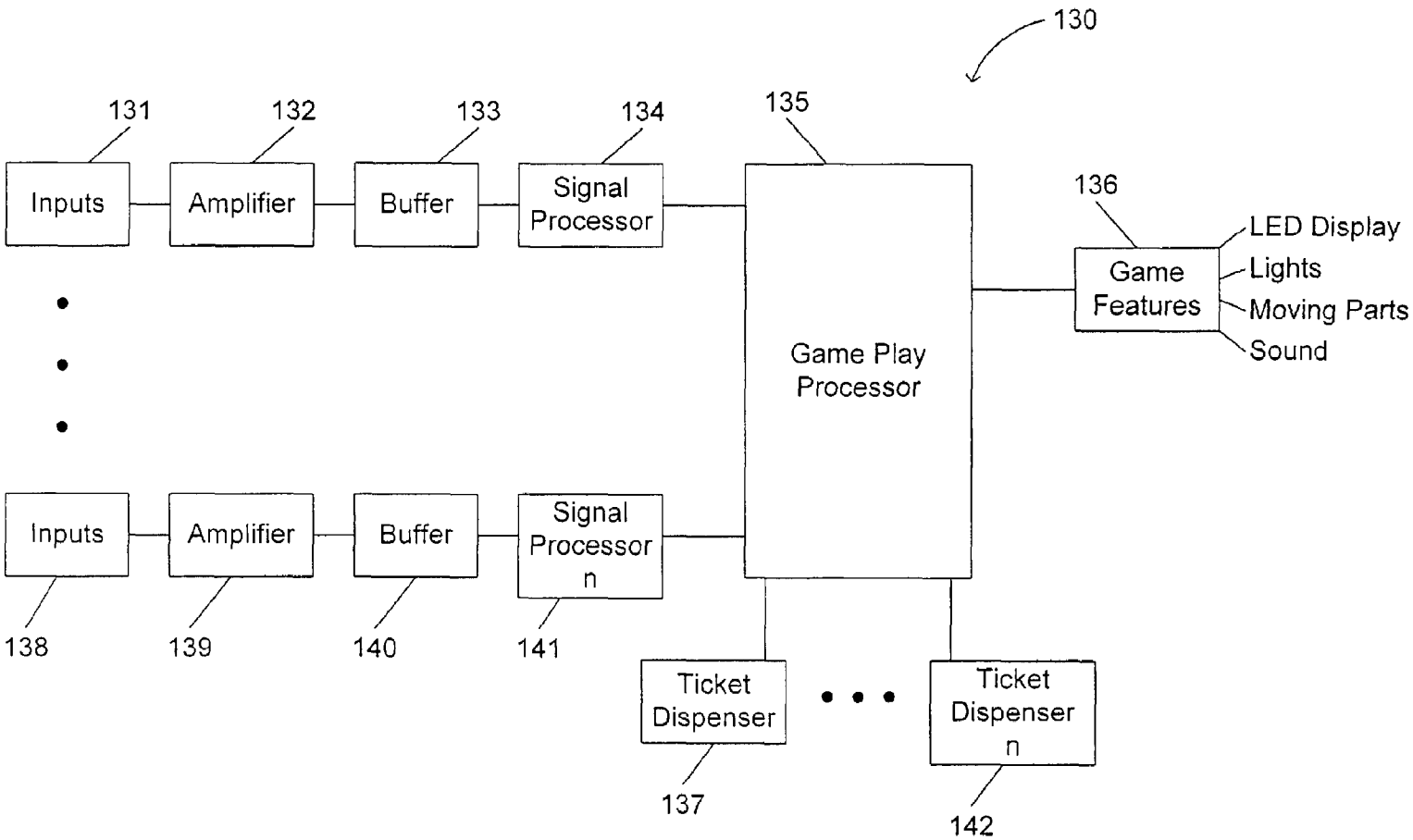
FIG. 8 is a block diagram of the game apparatus circuitry according to one embodiment of the present invention.

The circuitry controlling the operation of the game apparatus for embodiment of the present invention is shown in FIG. 8. The game control circuitry includes an input 131, an amplifier 132, a buffer 133, an input signal processor 134, a game play processor 135, game features 136, and ticket dispenser 137. In one embodiment, the game control circuitry has multiple inputs, in which case the game apparatus has inputs up to input N 138. In such case, each input has a corresponding amplifier 139, buffer 140, signal processor 141, and ticket dispenser 142. The game features controlled by the game play processor include speakers, LEDs, lights, moving parts, and other miscellaneous game features that may appear in an arcadetype game.

Figure 9:
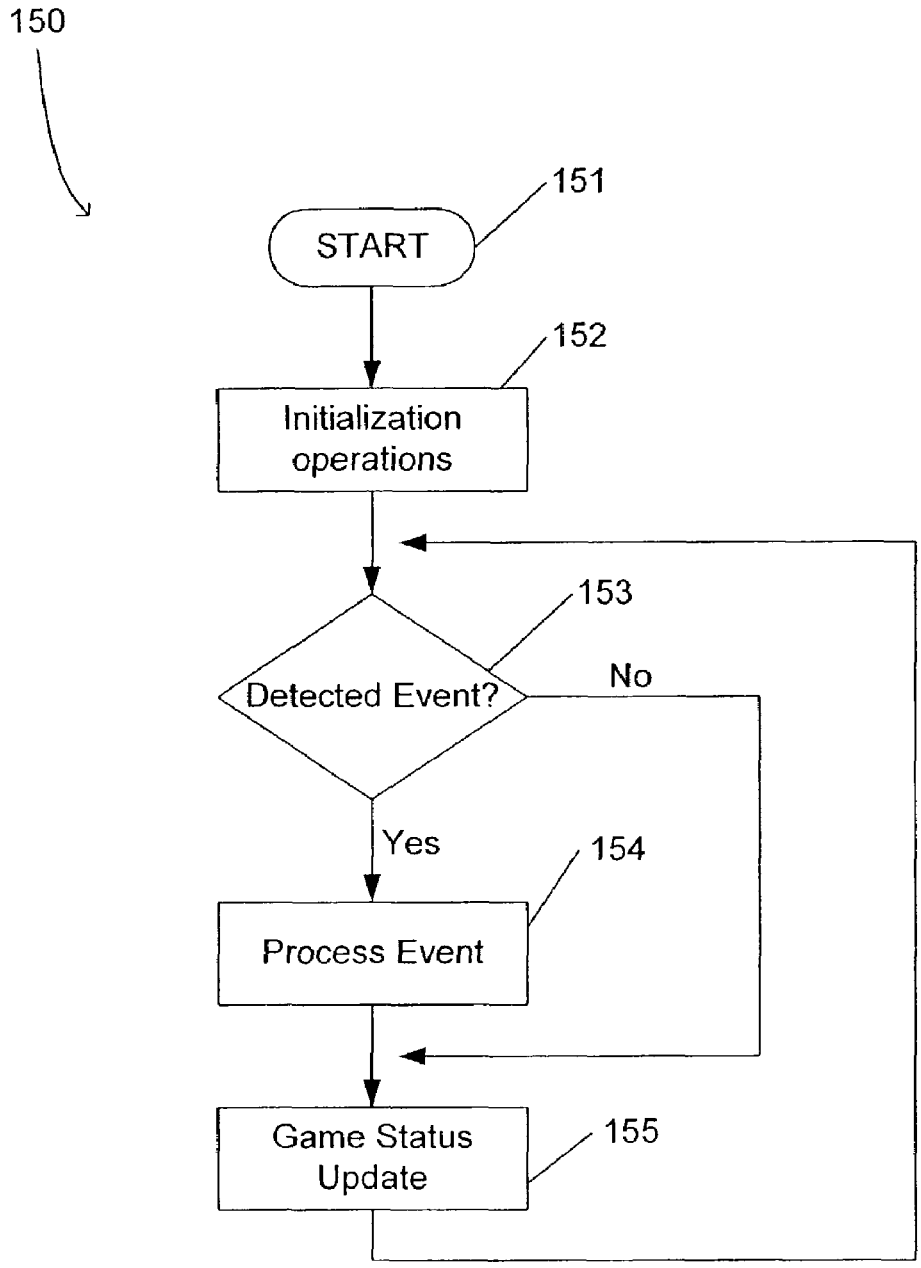
FIG. 9 is a flow diagram illustrating the operation of a game apparatus in one embodiment of the present invention.

With reference to FIG. 8, the operation of the game apparatus is shown in the flow diagram of FIG. 9, in accordance with one embodiment of the present invention. Game apparatus step 150 begins with an start step 151. A next step 152 performs initialization operations for the game play processor and other devices. Then, the step 153 determines whether or not an event has been detected. In one embodiment of the present invention, an event can be when a playing piece has successfully engaged a target. This may occur when a playing piece makes contact with a surface or enters a specific area within the game apparatus. In one embodiment, the specific area may be a well located on the target surface. Those skilled in the art will appreciate that there are endless possibilities for an event involving a playing piece engaging a target, all of which are considered within the scope of the present invention. If no event is detected, the process proceeds to an update game status step 155. If an event is detected, then the event is processed in step 154. After processing the event, the step 150 continues to game status update step 155. Finally, game apparatus operation returns to step 153.

Figure 10:
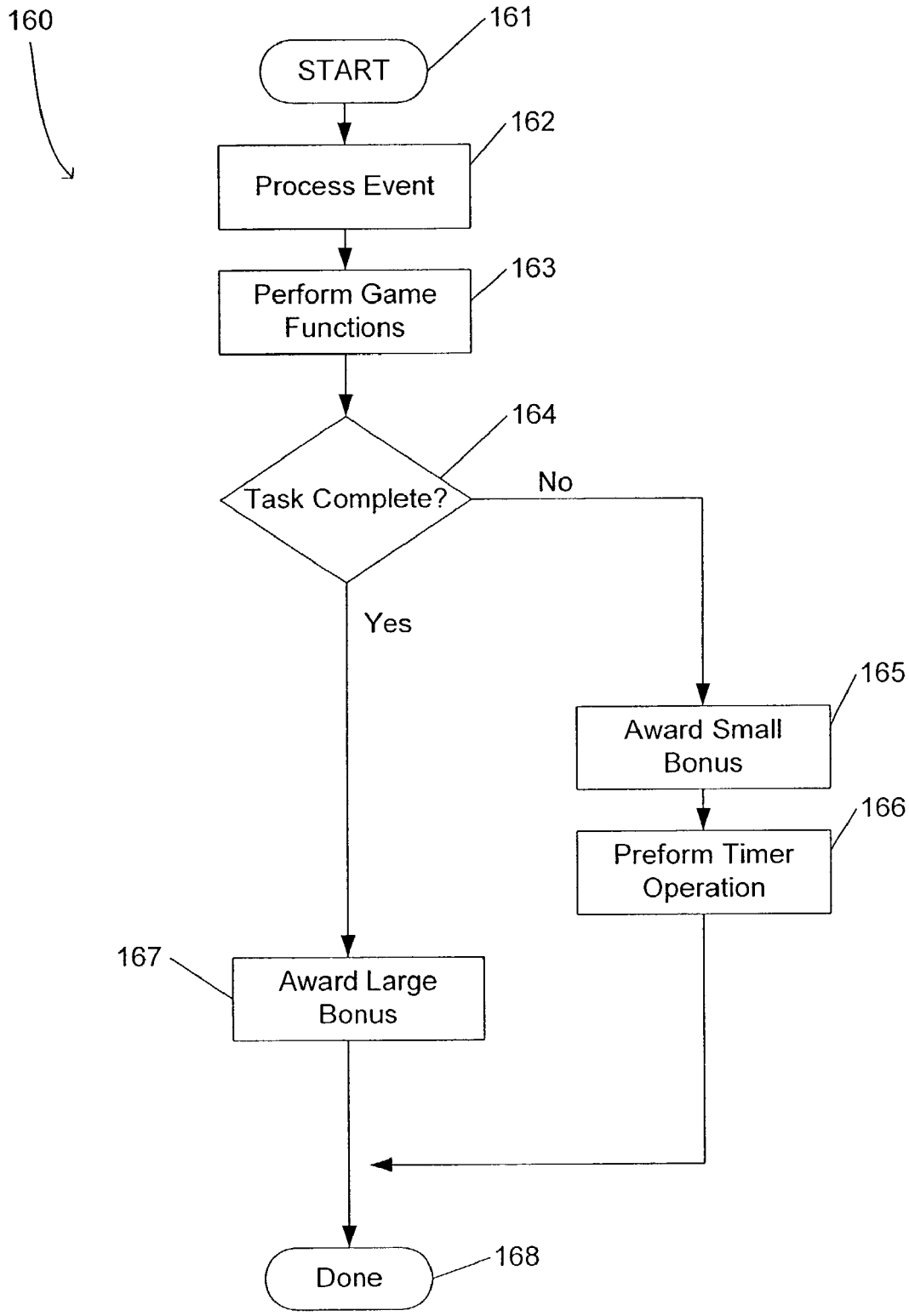
FIG. 10 is a flow diagram illustrating the "PROCESS EVENT" operation of FIG. 9.

FIG. 10 depicts a flow diagram showing the "PROCESS EVENT" operation/step of FIG. 9 in more detail, in accordance with one embodiment of the present invention. The process event step 160 in FIG. 10 begins with a start step 160. Next, the event is processed in step 162. Processing the event shall now be described with reference to FIG. 8. First the event signal which originates from a detection device at the target is sent to an amplifier. The event signal is then amplified by amplifier 132, sent through a buffer 133, and then further processed by signal processor 134. The further processing may include filtering the signal, debouncing the signal, or performing other operations on the signal. Although signal processors 134 and 141 are depicted as processing the signal before it is processed by game play processor 135, those skilled in the art will appreciate that the game play processor 135 could receive the signal directly from signal processors 134 and 141 and provide the processing within the game play processor itself.

Returning to FIG. 10, the process continues with step 163 where the event signal is processed and game functions are performed. The particular game functions performed may depend on the event that has occurred. In one embodiment, the game functions performed depend on whether the event indicates a playing piece successfully engaged a target or was directed to the default well. In either situation, the game play processor may provide for game functions such as moving parts, sound effects, or lighting effects. Such game functions add an element of excitement to the game.

Next, in step 164, the game play processor may determine if a player has completed a task in a game. In one embodiment of the present invention, the task may require a player to successfully engage several targets on a target surface. The player may be required to accomplish a task within a specified period of time, within a single game session, or in an unlimited period of time. A single game session would allow a player unlimited plays with a playing piece to accomplish the task. However, the game status would reset once a player stopped playing for more than a specified period of time. This is described in more detail below. If in step 164 it is determined that the game task is not complete, the process proceeds to step 165 where a reward may be provided to the player causing the event. This may involve dispersing tickets through a ticket dispenser as shown in FIG. 8, adding credits to a magnetized card, or any other means of providing a reward. Next, the process proceeds to step 166 where a timer may be started. In one embodiment, the timer indicates a period in which a player must initiate a playing piece into the game apparatus before losing progress achieved to that point. For example, if a player at a particular game station has successfully engaged three of five required targets with playing pieces and the timer requires that the player initiate the next playing piece within one minute, then if a playing piece is not initiated by a player at that play station within the one minute the player must engage all five targets to accomplish the task, including re-engaging the three previously engaged targets, in order to complete the task. In another embodiment, the timer may simply indicate how long the particular target that was engaged for that event shall remain 'live' or in an 'on' status. In this embodiment, a player may be required to engage all five targets within a certain period of time. Returning to the process event step 160, if the task is completed, the process continues from step 164 to step 167 where a larger reward is dispersed to the player accomplishing a task. In one embodiment of the present invention, the reward is a large or entire portion of a bonus. The process event operation then ends in step 168.

Figure 11:
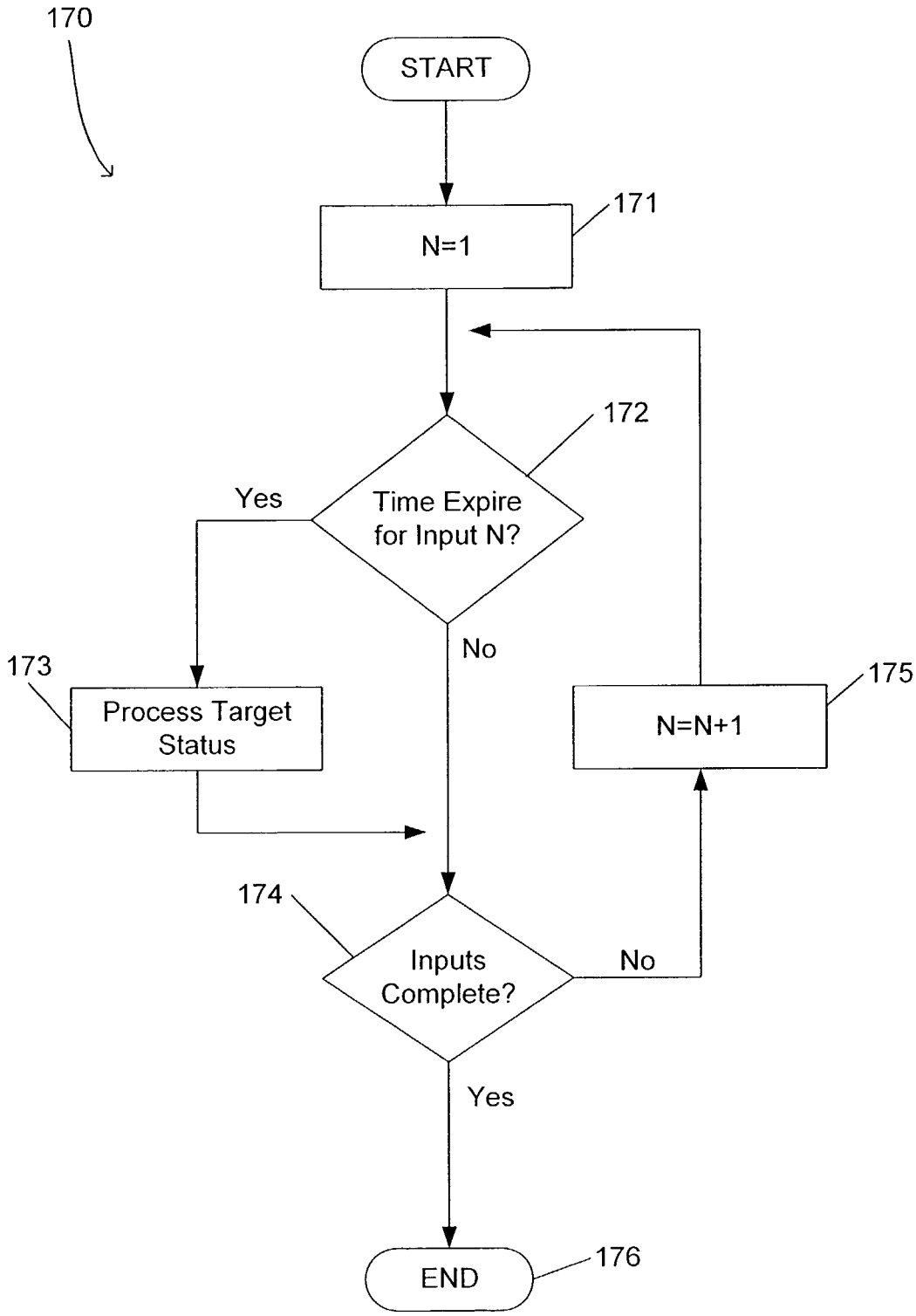
FIG. 11 is a flow diagram illustrating the "GAME STATUS UPDATE" operation of FIG. 9.

FIG. 11 is a flow diagram showing the "GAME STATUS UPDATE" operation of FIG. 9, in accordance with one embodiment of the present invention. It should be noted that the game status update operation depicted in FIG. 11 is only one embodiment of the present invention for resolving timing issues in achieving a task in the game apparatus. In particular, the game status update step 170 of FIG. 11 is one possible method for carrying out the embodiment where each target is 'live' for a particular period of time, as discussed above. Those skilled in the art will appreciate there are innumerable ways for providing a timing restraint on achieving a task, all of which are considered within the scope of the present invention.

The game status update process 170 begins with a start step 170. Next, a variable N is initialized to have a starting value of 1. Then, step 172 determines if the timer has expired for input N. If the timer for input N has expired, then the process continues to step 173 to change the 'live' or 'on' status of the active target to a 'dead' or 'off status. In addition to changing the status of the input and corresponding target, the operation may perform game functions such as providing for moving parts, sound effects, and light effects. The process then continues to a input complete step 174. If in step 172 the timer for the input N in step 172 has not expired, then the process continues to step 174. In the input complete step 174, the process determines whether or not there are more inputs to check. If there are more inputs to check, then the process continues to step 175 where N is incremented by one. After step 175, the process proceeds to step 172 to determine if the timer for the next input has expired. If there are no more inputs to check in step 174, the process proceed to step 176 where the operation is complete.

While this invention has been described in terms of several preferred embodiments, it is contemplated that alternatives, modifications, permutations and equivalents thereof will become apparent to those skilled in the art upon a reading of the specification and study of the drawings. It is therefore intended that the following appended claims include all such alternatives, modifications, permutations and equivalents as fall within the true spirit and scope of the present invention.

What is claimed is:

1. A game apparatus comprising:

a playing piece directed by a player;

a guiding mechanism having a first motion;

a target surface having a second motion, said second motion being different than said first motion, and at least one target, wherein said player directs said playing piece to engage said guiding mechanism in order to engage said target;

and wherein said first motion is initiated by a rotating member, said rotating member having an outer surface with a non-circular circumference coupled to said guiding mechanism, said rotating member's rotation providing said guiding mechanism with said first motion.

2. The game apparatus of claim 1 wherein said playing piece frictionally engages said guiding mechanism.

3. The game apparatus of claim 2 wherein said guiding mechanism includes a rail for directing said playing piece in a pre-determined manner.

4. The game apparatus of claim 1 wherein said first motion is a bi-directional motion.

5. The game apparatus of claim 1 wherein said first motion is a cyclic motion.

6. The game apparatus of claim 5 wherein a period of said cyclic motion is controlled by a user.

7. The game apparatus of claim 1 wherein said second motion is a cyclic motion.

8. The game apparatus of claim 1 wherein said second motion is a substantially bi-directional motion.

9. The game apparatus of claim 1 wherein said second motion is perpendicular to said first motion.

10. The game apparatus of claim 1, wherein said target surface forms a substantially cylindrical structure, wherein said second motion is a rotational motion such that said second motion of said target is perpendicular to said first motion of said guiding mechanism.

11. The game apparatus of claim 1, wherein said game apparatus has more than one game, each game having a guiding apparatus corresponding to a set of targets, wherein each set of targets is capable of being engaged only by said playing piece directed through said guiding mechanism corresponding to the set of targets.

12. The game apparatus of claim 1, further comprising an electrical motor and a connecting member, a first end of said connecting member coupled to said electrical motor and a second end of said connecting member coupled to said target surface, wherein motion provided by said electrical motor is transferred to said target surface through said connecting member.

13. The game apparatus of claim 1, further comprising a bonus, wherein a portion of said bonus is awarded to said player upon successfully engaging said target, an entire bonus awarded to said player upon successfully engaging an entire set of targets.

14. The game apparatus of claim 11, wherein said each set of targets must be engaged by said player within a set period of time.

15. A game apparatus comprising:

a first moving part having a first range of motion, said first range of motion being automated and controlled by a user by setting a first level of difficulty associated with said first range of motion;

a second moving part having a second range of motion, said second range of motion being automated;

a gaming token;

a default zone;

wherein said gaming token is initiated by a user into said first moving part and slides or rolls along said first moving part due to said first range of motion and a gravitational force;

wherein said gaming token further performs one act determined by a skill of said user from the following set of acts comprising:

engaging said second moving part when said gaming token slides or rolls off said first moving part;

engaging said default zone when said gaming token slides or rolls off said first moving part; and wherein a reward is determined based on which of said second moving part and said default zone is engaged by said token.

16. The game apparatus of claim 15 wherein said reward is displayed on said same apparatus.

17. The game apparatus of claim 15, wherein said reward may be affected by which section of said second moving part said token engages.

18. The game apparatus of claim 15, wherein said user controls some of said second range of motion of said second moving part by setting a speed of said second range of motion.

19. The game apparatus of claim 15, wherein a counterfeit measure is incorporated into said first moving part.

20. The game apparatus of claim 15, wherein said second moving part has a plurality of wells, at least one of which said token must enter to properly engage said second moving part.

21. The game apparatus of claim 20, wherein said reward is further affected by which of said plurality of wells said token engages.

22. The game apparatus of claim 20, wherein said reward is further affected by which of said plurality of wells said token engages in multiple applications of said game apparatus.

23. The game apparatus of claim 22, wherein said multiple applications are time sensitive.

* * * * *